US006092254A

United States Patent [19]

Kay

[11] Patent Number: 6,092,254

[45] Date of Patent: Jul. 25, 2000

[54] SUNSCREEN AND LOTION APPLICATOR

[76] Inventor: John Kay, 270 NE., 191 St. #106, N. Miami, Fla. 33179

[21] Appl. No.: 08/890,524

[22] Filed: Jul. 9, 1997

[51] Int. Cl.[7] ..... A47L 13/12

[52] U.S. Cl. ..... 15/118; 15/105; 15/210.1; 206/0.81; 206/229; 401/6

[58] Field of Search ..... 15/105, 118, 210.1, 15/244.1, 244.2; 206/0.81, 229, 581; 401/6

[56] References Cited

U.S. PATENT DOCUMENTS

| | | | |
|---|---|---|---|
| 1,239,164 | 9/1917 | Cutler | 206/0.81 |
| 2,005,835 | 6/1935 | Williamson | 15/105 |
| 4,861,180 | 8/1989 | Adams | 401/195 |
| 4,883,380 | 11/1989 | Ritterman | 401/6 |
| 5,083,337 | 1/1992 | Jones | 15/105 |
| 5,360,111 | 11/1994 | Arispe | 401/6 |
| 5,692,261 | 12/1997 | Lops | 15/244.1 |

*Primary Examiner*—Terrence Till

[57] ABSTRACT

A compact sunscreen and lotion applicator for applying lotions and creams to the body which comprises upper and lower structures, folding upon each other, joined together by a locking hinge when open or closed. The upper structure consists of a spare absorbent pad with base, secured with holders, and the lower structure having the main absorbent pad, secured with another set of holders for use to apply lotions and creams. A cord and a hook is provided to carry away, and a snap lock for the closure is provided. Overlap seal around upper and lower structures is provided to protect from accidental leakage in bags and luggage. A tong is provided to remove oily absorbent pads. A watch, a coin compartment and a mirror are also provided.

1 Claim, 2 Drawing Sheets

SUNSCREEN AND LOTION APPLICATOR

CROSS-REFERENCE TO RELATED APPLICATIONS

1. Disclosure Document Ser. No. 366555 Filed Dec. 8, 1994

2. Disclosure Document Ser. No. 369086 Filed Jan. 20, 1995

3. Patent Application Ser. No. 08/383,815 Filed Feb. 6, 1995

4. Notice of Abandonment Ser. No. 08/383,815 dated Jun. 7, 1996

5. Patent Application Ser. No. 08/583,901 Filed Jan. 11, 1996 now abandoned

BACKGROUND OF THE INVENTION

1. Field of the Invention—Technical Field

The present invention relates to lotion applicators, used in applying lotions and creams to the body, and more particularly, to a compact, and selfcontained applicator, having a watch, a mirror and a coin compartment, that is readily available to the user.

2. Description of the Prior Art—Background Art

Currently, when sunbathers enjoy the outdoor activities, tanning salons using lotions and creams, elderly persons with medical and/or physical condition, there is a need for a compact lotion applicator that is effective, inexpensive, and easy to use so a user may apply lotions and creams to the body, without undue effort and/or complex set ups.

It has been reported that the ultraviolet radiation from the sun causes many instances and forms of skin cancer, particularly, to those with sensitive, or pale skin. Thus, when sun bathers and fans, using the outdoors for various activities, it is very difficult, if not impossible for a user to protect his, or her skin from the harmful effects of the sun. In particular, reaching the back, and other hard to reach areas of the body, without help from another person.

Doctors, nurses, home care personal, and physical therapists are required, from time to time, to treat, and apply certain medicated, and other creams to a patient for various treatments and conditions. It is rather, a messy undertaking using protective gloves, or the hands. In addition, a user who wishes to apply certain medicated cream on the joints to relieve pain, or other applications, such as body lotion, or as athletes, trainers, and coachs attempting to treat certain parts of a human body for various conditions, it is rather, a difficult task.

A variety of creams, oils, and lotions are readily sold at most drug and grocery stores, department stores, resort shops, and beaches. Many lotions and creams are sold in a variety of sun protective factors, or SPF's, that indicate the level of protection from the sun, with a higher, or lower protective factor.

Therefore, when a user attempts to protect the skin from the sun, he or she, would normally apply, or assist in applying the lotion, and/or cream to another person, by applying the mixture on the hands, and than, applying same on the skin. A messy and unpleasant undertaking, whereas the hands become greasy, and tacky, in which some users, simply avoid protecting their skin, thus increasing the risk of sunburns and skin damage.

In general, by nature, lotions and creams are made of substances, and texture that are sticky, and oily and are not recommended to be ingested. However, this may not be possible, since users do snack outdoors, thus, handling food with oily and contaminated hands is unavoidable.

In addition, while on the beach, users normally avoid wearing a watch, thus constantly, asking or searching for a watch, or the time. Furthermore, a user is unable to properly apply, and protect the face and eyes without a cosmetic mirror. A compartment for coins and change for parking meters, pay phone, and other use is not available.

Nothing is available in today's marketplace other than long wands with fixed heads, or flat folding handle with washable head to serve such purposes.

Thereafter, inventors created several types of applicators for use by sun bathers.

U.S. Pat. No. 4,941,226 to Kemper (1990) discloses two costly and complex models. The disadvantage with these applicators, in that, in order to replace or remove the used cottons and clamps, a direct contact with the hands is required making it a messy undertaking.

U.S. Pat. No. 5,360,111 to Arispe (1994) discloses a compact applicator. The disadvantage with this invention, is that, it requires assembly and disassembly for each use, pads replacement are a messy task, parts are too numerous, and too costly to make.

Another possible relevance are the following applicators sold in drug stores and other shops;

1. Applicator # 921, having a long handle and a pad.

2. Sun Mate, a folding type applicator with a permanent flat washable single pad.

3. Lotion Magic applicator 10–16 inches long.

Nevertheless, all the applicators heretofore known, suffer from a number of disadvantages as follows:

1. Their manufacture requires a large facility, in which to manufacture, and assemble the various parts, and/or;

2. If an injection mold was used, the various molds required for the production of the various parts, would be too costly to make, thus, uneconomical to manufacture and/or;

3. The prior arts, in general, do not offer to the consumer a low cost, an attractive, and a practical applicator and/or;

4. The prior art applicators do not offer an applicator that would not require the user to touch the oily pads with the hands to replace, dispose, and/or remove the oily pads.

5. The prior art applicators, do not offer the consumer a compact applicator with a watch, a mirror and a coin dispenser.

Finally, the prior art, designs and makes, are generally inferior and show a lack of simplicity.

SUMMARY OF THE INVENTION

Accordingly, the main object, according to the present invention, is to provide a compact sunscreen and lotion applicator. Several objects and advantages of the present invention are;

a. to provide a sunscreen and lotion applicator that can be made from inexpensive and readily available materials, such as plastic resins, ABS, or alike, in a variety of colors, with an injection mold, commonly used in the plastic industry.

b. to provide a pleasant looking, sunscreen and lotion applicator, whereas no assembly or set-ups are required by the user for each use and/or storage, at a low cost.

c. to provide a sunscreen and lotion applicator, that would eliminate messy hands when used to replace, dispose and/or remove a used oily pads, using the tong.

d. to provide a sunscreen and lotion applicator, whereas the user, can reach all parts of the body, with ease and comfort without assistance.

e. to provide a sunscreen and lotion applicator with a spare pad storage, and replacement, for the different types of lotions and creams with ease, convenience, and simplicity.

f. to provide a sunscreen and lotion applicator, with absorbent pad, sponge, foam, or alike, with a firm base and/or backing, to fit and hold snugly in said applicator.

g. to provide a sunscreen and lotion applicator, that offers a sealed unit to prevent accidental leakage in bags, handbags, and luggage, when not in use.

h. to provide a sunscreen and lotion applicator with a hook for display and a cord to carry around the wrist, for ease and convenience.

i. to provide a compact sunscreen and lotion applicator that offers a watch in order to keep track of time, a mirror to protect the face and eyes, and a coin dispenser for parking, telephone, etc.

Further objects and advantages will become apparent from a consideration of the ensuing description, and drawings.

REFERENCE NUMERALS IN DRAWINGS

Figure 2:
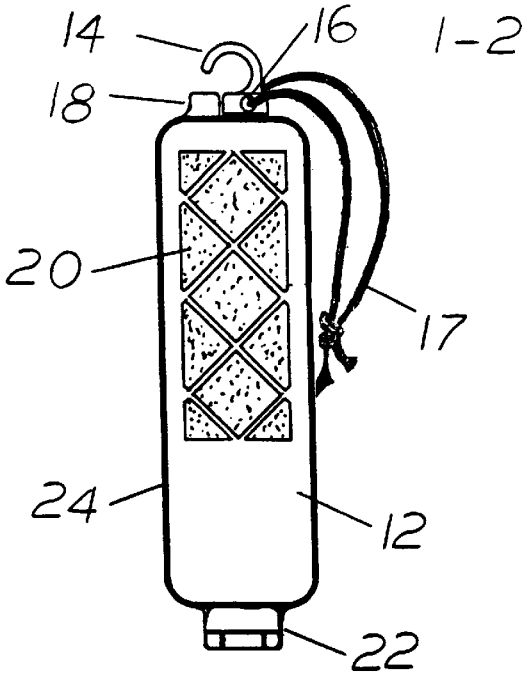
FIG. 2 is a top view of the present invention, in its closed position, a locking hinge, a hook, a void with a cord, an overlap seal, and a hand grip thereof.
Figure 1:
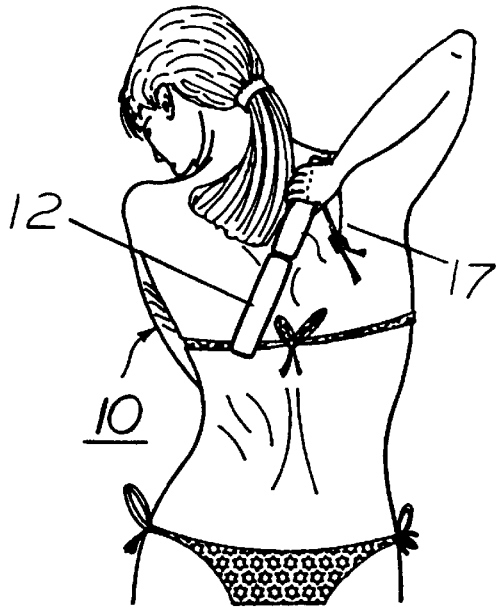
FIG. 1 shows a back of a typical user using the applicator of the present invention with a right hand.

| FIGS. # | PART # | PART NAME |
|---|---|---|
| 1 | 10 | user |
| 1–6 | 12 | applicator |
| 2–5 | 14 | hook |
| 2,4 | 16 | void |
| 1–5 | 17 | cord |
| 2–6 | 18 | snap lock |
| 2,3,5 | 20 | hand grip |
| 2–6 | 22 | locking hinge |
| 2–5 | 24 | overlap seal |
| 3–5 | 26 | main absorbent pad with backing |
| 3–5 | 28 | spare absorbent pad with backing |
| 3 | 29 | absorbent pad backing |
| 3,4,6 | 30 | holders |
| 3–5 | 32 | upper structure |
| 3–6 | 34 | lower structure |
| 4,6 | 36 | support pins |
| 4,7 | 40 | tong |

-continued

REFERENCE NUMERALS IN DRAWINGS

| FIGS. # | PART # | PART NAME |
|---|---|---|
| 4,7 | 42 | finger grip |
| 4,6,7 | 43 | pad grip |
| 4 | 44 | tong base |
| 3 | 46 | mirror |
| 3,6 | 48 | watch |
| 3 | 50 | watch base |
| 3,6 | 52 | coin compartment |
| 3 | 54 | coin compartment cover |
| 3 | 56 | cover grip |
| 6 | 58 | self closing hinge |

DESCRIPTION OF THE PREFERRED EMBODIMENT(S)

Best Mode for Carrying Out the Invention:

In order to promote an understanding of my invention, references will now be made to the embodiments in the drawings, and specific language will be used to describe same.

It will, nevertheless be understood, that no limitations of the scope of the present invention, is thereby intended, there being contemplated, such alterations, and modifications of the illustrated devices, and such further applications of the principles of the invention, as described herein, as would normally occur, to one skilled in the art, to which the invention relates.

Figure 5:
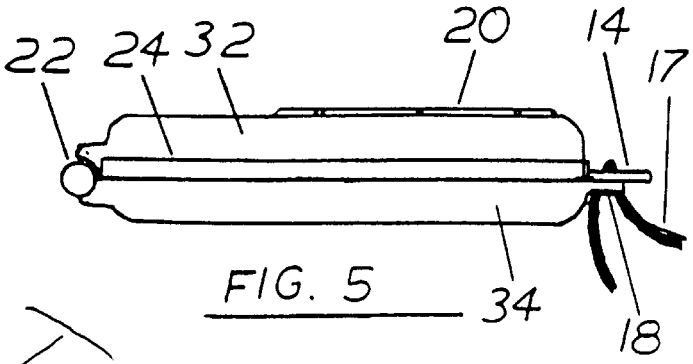
FIG. 5 is a side view of the present invention, in closed position with various parts thereof.

Applicator 12 of the present invention, a compact sunscreen and lotion applicator container, in its closed position as seen in FIGS. 2, 5, is a tubular, two parts structure, namely, first; upper structure 32, and second; lower structure 34.

The upper and lower structures, 32, and 34, respectively, are attached together by hinge 22 at one end of applicator 12.

Figure 3:
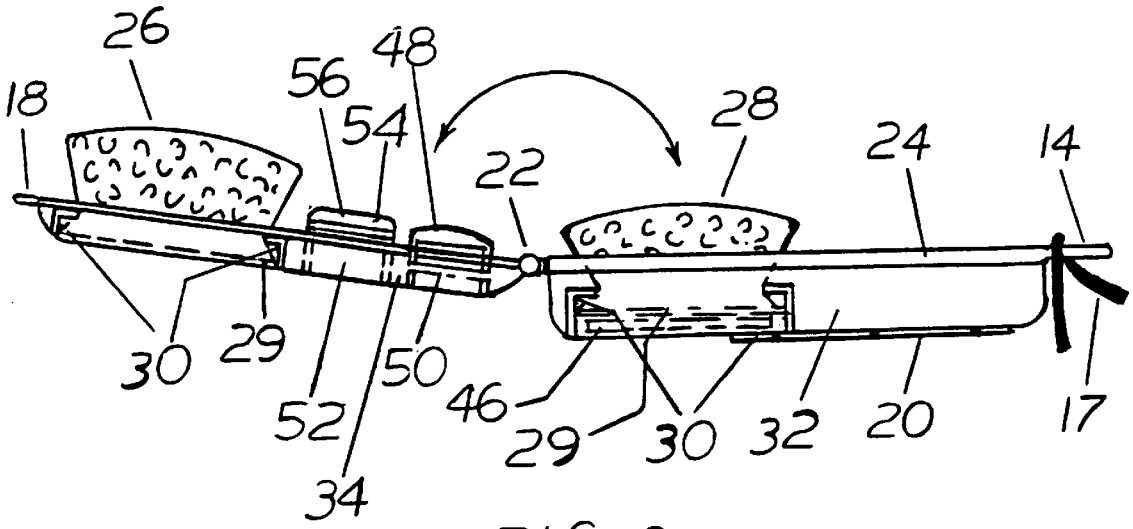
FIG. 3 is a side view of the present invention, in open angle position, ready for use, upper structure with a spare absorbing pad and backing, and a mirror. Lower structure, with a main absorbent pad and backing, a locking hinge in a pre-fixed position, a watch, a coin compartment, and other various parts thereof.
Figure 4:
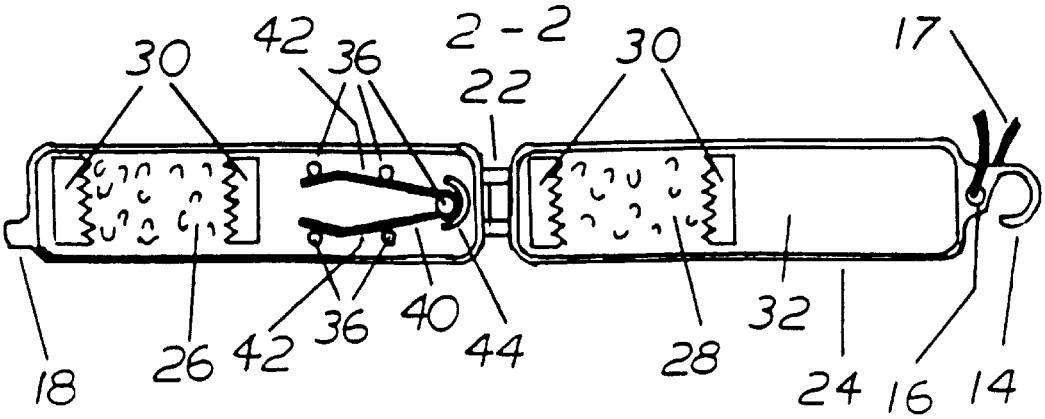
FIG. 4 is an inside, top view of the present invention, in open position with a tong, and arrangement thereof.

When applicator 12 is fully open and extended, FIGS. 3, 4, at an angle of 165 to 175 degrees, user 10 may reach all parts of the body with ease. Locking hinge 22 FIGS. 2, 3, 4, 5, 6, having spring like tension, with male/female, projection/cavity, arrangements, and design, wherein, will allow hinge 22 to stop at a pre-determined, open fixed angle of 165 to 175 degrees. When hinge 22 is open, extended, and ready for use, it will not close accidentally, and would require a moderate pressure, FIG. 3 to fold and/or close said applicator 12.

The upper structure, and handle 32 of applicator 12 FIGS. 3, 4, 5, 6, having a spare absorbent pad 28 with pad backing 29, FIG. 3, held firmly and secured in place by holders 30. A mirror 46 FIG. 3 is also provided. A hook 14 FIGS. 2, 4, allowing user 10 and shopkeepers to hang, and/or display applicator 12. A void 16 FIGS. 2, 4, is provided for cord 17 for user 10 to carry with convenience around the wrist, neck, or hanging.

Figure 6:
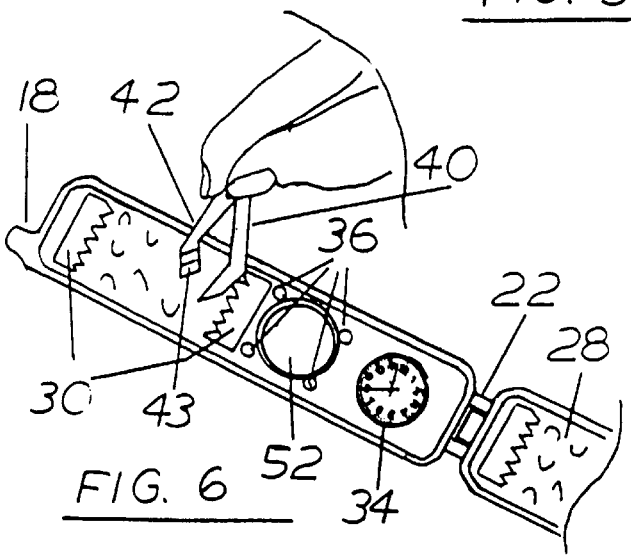
FIG. 6 is a perspective view of a lower structure of the present invention, in open position, showing a typical user with a tong, and the manner in which a tong is used to remove oily pads, a watch, a coin compartment, and other various parts thereof.

Lower structure and base 34 of applicator 12, FIGS. 3, 4, 6, with main absorbent pad 26, and pad backing 29, is for user 10 to apply lotions and creams as needed, held firmly and secured in place by holders 30. A watch 50, coin compartment 52, a coin compartment cover 54, a coin compartment cover grip 56, and a self closing hinge 58, are also provided.

Figure 7:
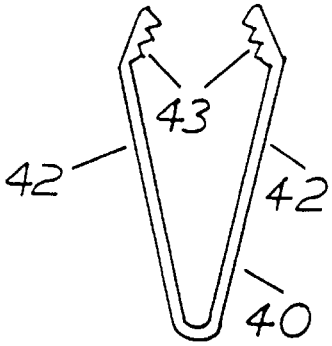
FIG. 7 is a top view of a tong with various shapes and configurations thereof.

Tong 40 nests in lower structure 34, FIG. 4, with tong base 44, when not in use, and supported by support pins 36, for use when desired by user 10. Tong 40, FIG. 7, having finger grip 42, and pad grip 43. FIG. 6 shows the manner in which user 10 removes, replaces, and/or disposes of wet, and oily absorbent pads 26 and 28, without having to touch the oily pads with the hands.

FIG. 3, shows a mirror 46 in upper structure 32.

When applicator 12 is fully closed, FIGS. 2, 5, it will form one closed compact compartment, which fits snugly upon both structures 32 and 34. Overlap seal 24 is designed to keep excess oil from accidentlly leaking onto luggage, garment and bags. Snap lock 18, FIGS. 2, 4, 6, is a lever, used to open applicator 12 FIG. 3, with ease, in a safe manner, allowing user 10 to open applicator 12 by depressing, and/or twisting clockwise, on snap lock 18 and hook 14 at the same time, to pry open, and/or depress shut said applicator 12.

Hand grips 20 on applicator 12, on upper structure 32, FIGS. 2, 5, are provided, to distinguish between lower structure 34, and upper structure 32, and to provide for a firm grip with wet, or sweaty hands by user 10.

It is hoped that when the need of the compact sunscreen and lotion applicator 12 is made known to doctors, hospitals, health care providers, athletes and physical therapists, they may wish to provide the convenience offered by applicator 12 to their respective clients/patients. In addition, applicator 12 will be offered to the general public as a useful product.

From the description above, a number of advantages of my compact sunscreen and lotion applicator become evident;

a. An applicator that would not require the user to use the hands to apply lotions and creams to the skin and body.

b. An applicator that would not require a user to handle oily absorbent pads with the hands in order to remove, replace and/or dispose of oily absorbent pads.

c. With the applicator as shown, there is no assembly or set-ups required on the part of the user.

d. With the introduction of bright and attractive colors from common and inexpensive plastic resins, or alike, production cost, and the cost to the consumer would be lower.

e. An applicator having a watch, a mirror and a coin compartment.

Although the descriptions above, contain many specifities, these should not be construed as limiting the scope of the invention, but as merely providing illustrations of some of the presently preferred embodiments of this invention. For example, the applicator can have other shapes, such as oval, and/or may be incorporated with a cosmetic kit assembly.

Thus the scope of the invention should be determined by the appended claims and their legal equivalent, rather than by the examples given.

What is claimed is:

1. A compact sunscreen and lotion applicator for applying lotions and creams to a body, comprising upper and lower structures, attached together by a hinge, at one end of said structures, to open along its length, to double the distance, which said structures fold upon each other to form a closed housing, said upper structure having a spare absorbent pad with a base attached, with means to hold said spare absorbent pad with a base attached, with means attached to carry said applicator, means attached to grip onto said applicator, with means attached to seal said upper and lower structures against leakage, having main absorbent pad with a base attached in lower structure, means to secure said main absorbent pad with base for use of said applicator; Further, said lower structure having means to open and close said structures upon each other, means to see a user's face, and either means to tell the time, means for containing coins or means for removal of said oily absorbent pads.

* * * * *